US005090068A

United States Patent [19]

Zellner

[11] Patent Number: 5,090,068

[45] Date of Patent: Feb. 25, 1992

[54] BATH WITH INTERFITTING SEAT

[76] Inventor: John R. Zellner, 1610 King Ave., Kings Mills, Ohio 45034

[21] Appl. No.: 631,089

[22] Filed: Dec. 19, 1990

[51] Int. Cl.[5] ..... A47K 3/12

[52] U.S. Cl. ..... 4/578.1; 4/611

[58] Field of Search ..... 4/571, 573, 575, 578, 4/579, 590, 611

[56] References Cited

U.S. PATENT DOCUMENTS

| | | | |
|---|---|---|---|
| 2,236,927 | 4/1941 | Thomas | 4/579 |
| 2,588,562 | 3/1952 | Parish | 4/579 |
| 2,813,276 | 11/1957 | Lanza | 4/579 |
| 3,579,668 | 5/1971 | Aronovitz | 4/578 |
| 4,400,835 | 8/1983 | Richter | 4/578 |
| 4,941,218 | 7/1990 | McCartney | 4/579 |
| 4,987,619 | 1/1991 | Smith | 4/611 X |
| 5,048,132 | 9/1991 | Rizzo | 4/578 |

*Primary Examiner*—Henry J. Recla
*Assistant Examiner*—Robert M. Fetsuga
*Attorney, Agent, or Firm*—Robert J. Zellner

[57] ABSTRACT

This invention provides a bath, including the tub and surround, adapted to receive a bathing seat which is readily removable but firmly positioned in use through an interfitting relation of the seat elements with components of the tub and the surround.

6 Claims, 2 Drawing Sheets

BATH WITH INTERFITTING SEAT

BACKGROUND OF THE INVENTION

Numerous studies have reported that the bathroom is the most dangerous room in the house and a bath tub is perhaps the most dangerous element in that room. As persons age, getting up from a relaxing soak becomes increasingly hazardous and difficult, to the point where a bench of some sort is employed in the tub.

In its arguably simplest form, such a bench is merely a stool with mar-resistant feet set in the tub. But such an arrangement is not entirely slip proof, is not aesthetically pleasing, and the transfer to it by a mobility impaired bather is often difficult.

An attempt to solve the slipping problem by clamping the bench to the tub is shown in U.S. Pat. Nos. 4,520,515 and 4,472,844, securing by clamps within the seat is shown in U.S. Pat. No. 3,875,597 and some provision for easier transfer is shown in U.S. Pat. No. 4,391,006. These and other solutions which have been developed to date are essentially "add on" arrangements and often are awkward when use of the bath is shared by a person who is not impaired and does not need, or want, the seating assistance.

SUMMARY OF THE INVENTION

It is an object of this invention, therefore, to provide a bath, including the tub and the surround, adapted to receive a seat which is readily removable, but firmly positioned in use, through an interfitting relation between the seat, the tub, and the surround. The seat of this invention also is light in weight, easy to clean and presents a pleasing appearance. In particular it is an object of the invention to provide a bath including an interfitted seat, the tub portion being defined by a head end, a foot end, a dam in front and a wall in the rear. A sill is above the tub wall and may be on a panel of the surround. A stop on the panel is located above the sill and extends toward the dam. A seat is supported on the top of the dam and the sill and between the head end of the tub and the stop. At least a portion of the seat extends into the tub between the dam and the wall and is in contact with them. In one embodiment the stop is intermediate the length of the wall. In a preferred embodiment the panel is a portion of a surround which is separate from the tub but secured to it in watertight engagement. In still another embodiment the seat has a curb on its back and side margins and a brim atop the curb and abutting the back and end walls. Water which is splashed is returned to the tub by a weir above the dam and a relief opening at the margin between the seat and the dam. A restraining finger extends from the interior of the seat to the inside of the dam to restrict or eliminate sidewise movement.

These and other objects of the invention will be understood from reference to the following detailed description and the drawings, wherein:

THE DRAWINGS

FIG. 1 is a view of the bath including the tub and surround and with an interfitted seat and FIG. 2 is perspective partial view of the seat interfitted in the head end of the tub and surround.

DETAILED DESCRIPTION

Figure 1:
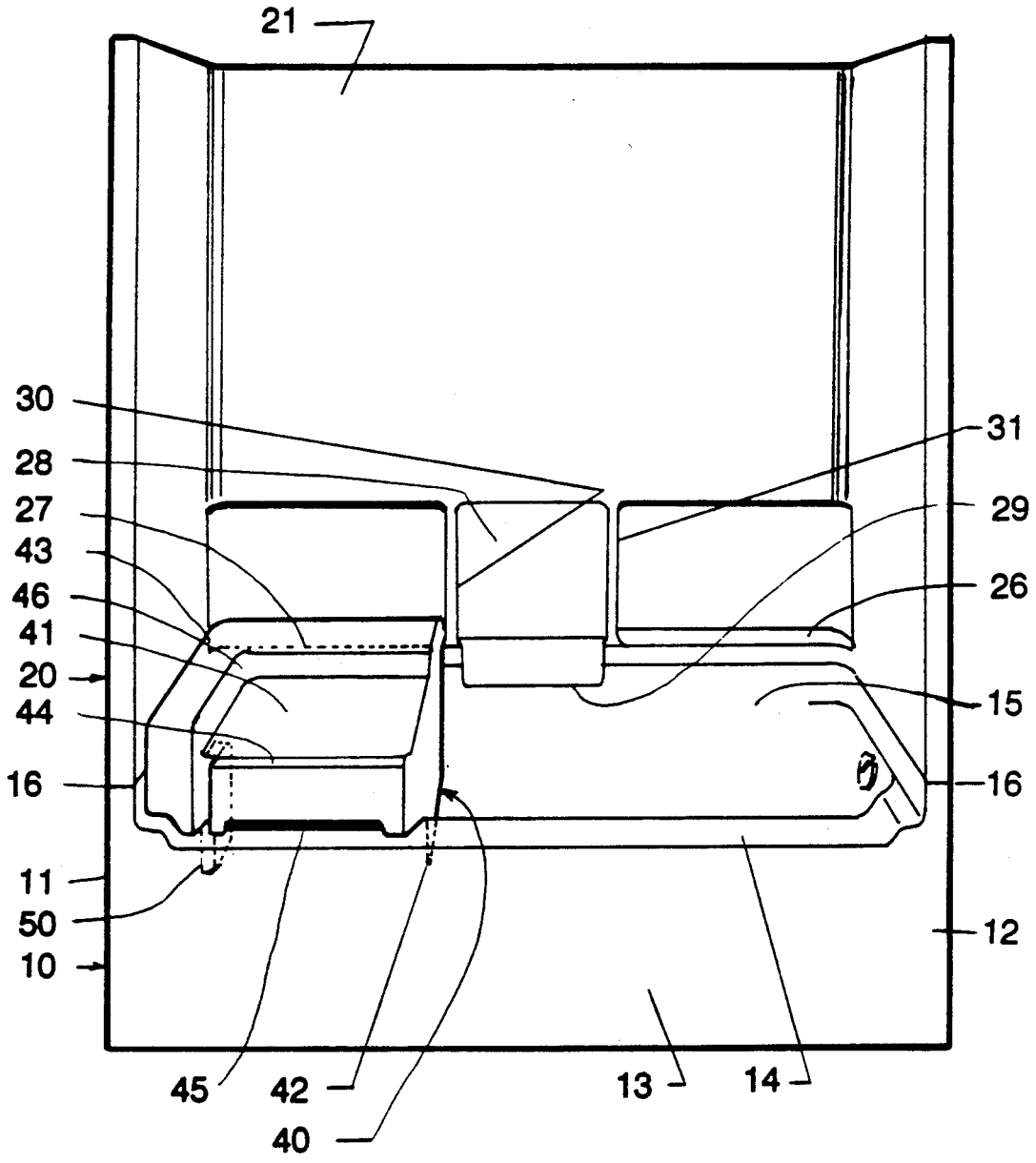

Referring now to FIG. 1, there is shown a bath tub 10 having a head end 11 and a foot end 12. The front is defined by a dam 13 having a top 14; the rear is defined by a wall 15. A surround 20 above the tub is optionally integral with it or a separate piece and secured to it in water tight relation at the joint line 16. The surround 20 has a panel 21 and a sill 26, the hidden portion of which is shown at 27 by the dashed line. A box 28 located on the panel between the tub ends 11 and 12, preferably about midway between them, houses an optional cascade water inlet 29 and has sides 30 and 31 which project from the panel 21 toward the dam 13. The sill 26 may be used to hold shampoo, soap or other bath accessories.

Interfitted with the tub 10 and the surround 20 is a seat 40 including a bench portion 41 supported at about chair height on the top 14 of the dam 13 and on the sill at 27 between the side 30 and the head end 11 of the tub. Thus the side 30 serves as a stop to restrict the seat from endwise movement toward the foot end 12 of the tub. A skirt portion 42 of the seat extends from the bench 41 into the tub so that sidewise movement of the seat is limited by contact of the skirt with the tub wall 15 and the inside of the dam 13. The seat is also limited in its movement by a curb 46 extending upward from the bench 41 on its back and side margins. A brim 43 caps the curb and contacts the surround 20. The weir 44 helps direct errant water back into the tub. A relief or opening 45 in the base of the seat also permits water to return to the tub and provides an opening to tuck in the shower curtain. A finger 50 shown in dashed lines extends downwardly from the seat into the tub near its head end and contacts the inside of the dam 13 to aid in maintaining the seat in its interfitted position.

Figure 2:
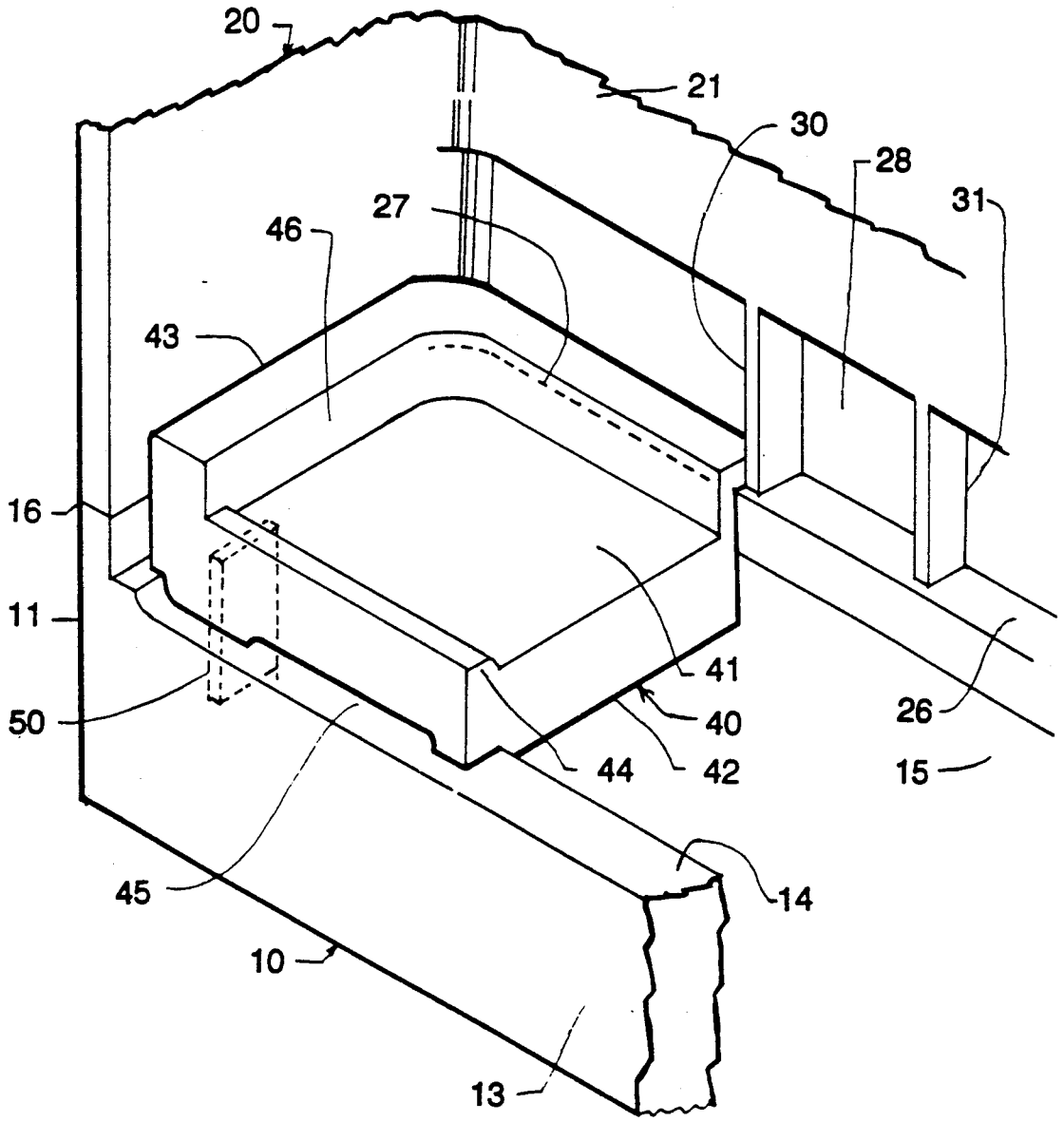

FIG. 2 shows a perspective view of the seat 40 and a partial view of adjacent portions of the tub 10 and surround 20 (broken away in part) and further illustrates the arrangement of the various parts, identified by the numbers set forth above, and their interfitting relation. Note that the optional cascade water inlet is not shown in this view.

Thus this invention provides a seat which is securely held against the tub and surround by the interaction of the elements described. Nevertheless, the seat is easily lifted from its position shown in the drawings and placed to one side when it is desired to use the tub in a conventional manner without a seat. The tub is then clear of residual clamps and other fittings without the necessity of operating screws, cams or other locking devices.

The embodiments described above and illustrated in the drawings are, of course, to be regarded merely as non-limiting examples and as to their details may be modified in several ways within the scope of the following claims.

I claim:

1. A bath comprising a tub and a surround, said tub being defined by a head end wall, a foot end wall, a dam wall in front and a wall in the rear, said surround having a panel above and substantially parallel to the tub rear wall, said panel having a sill above said rear wall, a stop on said panel above said sill and extending toward the dam wall, an interfitted seat having a base supported on the top of the dam wall and the sill and between the head end wall and the stop, at least a portion of the base extending into the tub and in contact with the rear wall and the inside of the dam wall, whereby said stop and said base retain said seat in a desired position.

2. A bath according to claim 1 wherein the stop on the surround is intermediate the length of the tub wall.

3. A bath according to claim 1 wherein the surround comprises a separate panel surmounting the tub in watertight engagement with it.

4. A bath according to claim 1 wherein the seat has a curb on back and side margins thereof, and a brim atop the curb and abutting the surround.

5. A bath according to claim 1 including a weir on the seat to divert water into the tub, and a relief in the base of the seat between the seat and the dam.

6. A bath according to claim 1 including a finger extending from the seat into the tub and in contact with the inside of the dam near the head end of the tub.

* * * * *